United States Patent [19]

Jamieson

[11] 4,213,412

[45] * Jul. 22, 1980

[54] METHOD AND APPARATUS FOR MINIMIZING DRAG OF PLURAL-HULL CRAFT

[76] Inventor: Robert S. Jamieson, 147 N. Catalina St., Los Angeles, Calif. 90004

[ * ] Notice: The portion of the term of this patent subsequent to Jan. 20, 1993, has been disclaimed.

[21] Appl. No.: 825,441

[22] Filed: Aug. 17, 1977

Related U.S. Application Data

[60] Continuation of Ser. No. 612,630, Sep. 12, 1975, abandoned, which is a division of Ser. No. 456,846, Apr. 1, 1974, Pat. No. 3,933,110.

[51] Int. Cl.[2] ..... B63B 35/00

[52] U.S. Cl. ..... 114/61; 114/39

[58] Field of Search ..... 114/39, 56, 61, 102, 114/242, 248, 249, 77 R; 9/6 R, 2 S

[56] References Cited

U.S. PATENT DOCUMENTS

| | | | |
|---|---|---|---|
| 815,737 | 3/1906 | Pool | 114/39 |
| 1,005,236 | 10/1911 | Larr | 114/248 |
| 1,406,602 | 2/1922 | Baer | 114/249 |
| 3,190,587 | 6/1965 | Fries | 9/6 R |
| 3,345,970 | 10/1967 | De Long | 114/249 |
| 3,691,976 | 9/1972 | Wilson | 114/39 |
| 3,933,110 | 1/1976 | Jamieson | 114/61 |

*Primary Examiner*—Trygve M. Blix
*Assistant Examiner*—Jesus D. Sotelo

[57] ABSTRACT

A plural-hull craft incorporates separate hulls pivotally attached at the extremities of an interconnecting structure, which hulls may be rotated either separately or in unison to longitudinally align two or more hulls with substantial hydrodynamic continuity, whereby leeward hull buoyancy is increased to improve longitudinal stability. The drag incurred between the longitudinally-aligned hulls is substantially reduced by shaping the adjacent bow and stern to be conjugates, or by use of a fairing which extends the contours of the forward hull into the aft hull.

15 Claims, 15 Drawing Figures

FIG. 11.
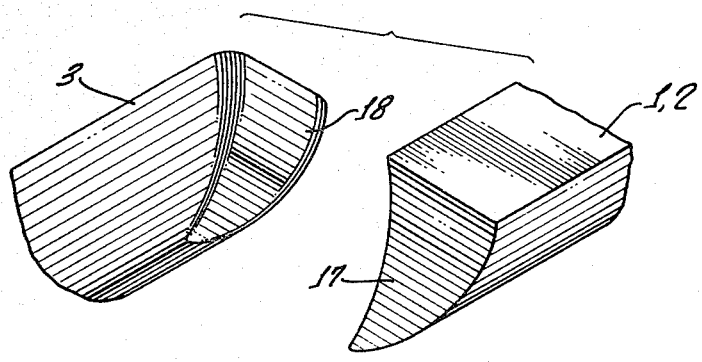
FIG. 12.
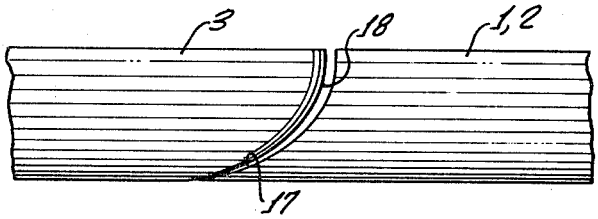
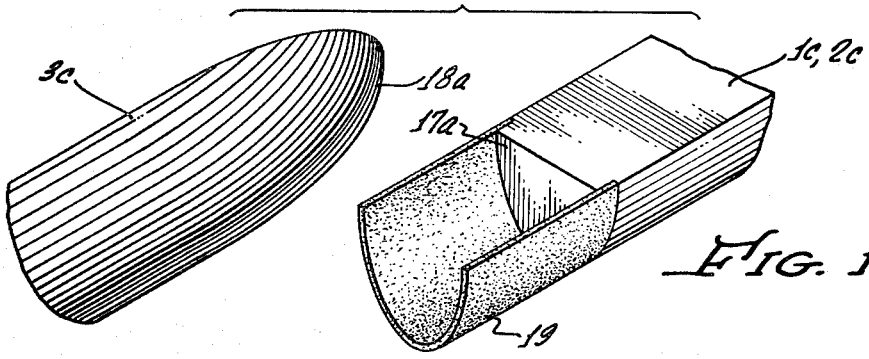
FIG. 13.
FIG. 14.
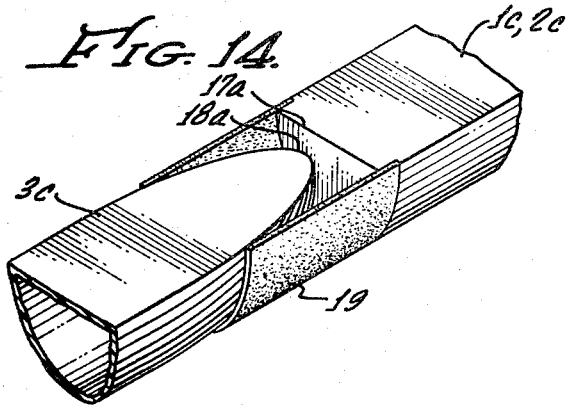
FIG. 15.
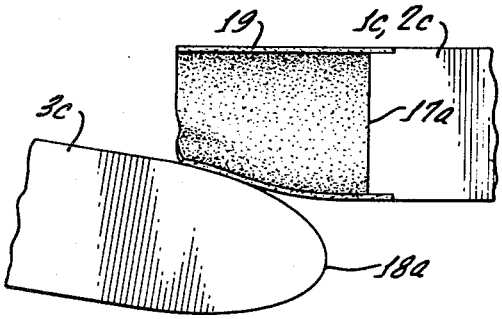

METHOD AND APPARATUS FOR MINIMIZING DRAG OF PLURAL-HULL CRAFT

This is a continuation of application Ser. No. 612,630, filed Sept. 12, 1975, now abandoned; which prior application was a division of application Ser. No. 456,846, filed Apr. 1, 1974, now U.S. Pat. No. 3,933,110.

BACKGROUND OF THE INVENTION

1. Field of the Invention

The invention relates to the field of plural-hull craft, and more particularly concerns an arrangement of independent hulls and interconnecting structure.

2. Description of the Prior Art

Plural-hull sailing craft, including outrigger canoes, proas, catamarans and trimarans, are often preferred over comparable monohull sailing craft because of their greater speed and lateral stability, and their shallower draft. The greater speed derives largely from the greater lateral stability which allows more sail to be carried than can be carried by comparable monohull craft.

Lateral stability, that is, stability against heeling or capsizing under lateral sail forces, is normally derived on monohull sailboats by a combination of buoyancy change with angle of heel, ballast and/or weighted keels. When ballast or a weighted keel is used, as both generally are in larger craft, additional hull buoyancy, in the form of a larger single hull, is required to support the additional weight. This larger hull causes an increase in water drag which reduces maximum speed.

Plural-hull sailing craft, however, achieve excellent lateral stability almost exclusively from lateral separation of the hulls. Before lateral sail forces can heel such craft over, upwind hulls must necessarily be lifted from their normal buoyant positions. Buoyancy of lifted hulls is reduced and the resultant increased hull weight, acting at the separation distance from downwind hulls, exerts a restoring force which counteracts further heeling. Additionally, the more deeply submerged leeward hull exerts a buoyant righting moment. These restoring forces are maximized at heeling angles which completely lift or fly the upwind hull or hulls free of the water.

Also, because of the comparatively light weight of at least smaller plural-hull craft, crew weight is commensurate with the weight of the craft and additional lateral stability can be achieved by optimum crew placement.

As plural-hull sailing craft normally do not employ weighted keels or carry ballast, they require less hull buoyancy than comparable monohull sailing craft and can use slender, shallow draft hulls with lower water drag. Also, inasmuch as these type craft have good lateral stability, they can carry much larger sails than comparable monohull craft with less danger of lateral capsizing. Lower hull drag and greater sail area account for the relatively high speed of plural-hulled craft.

Another advantage of plural-hull craft becomes apparent when theoretical hull speed—a theoretical upper speed limit of hulls in knots equal to 1.4 times the square root of hull length in feet—is considered. At this theoretical speed water drag abruptly and significantly increases, and greatly increased driving force is required to drive the hull faster. This theoretical hull speed limit is generally the limiting speed for monohull sailboats (except when planing) because at this speed there is usually insufficient sail power in reserve to overcome the increased hull drag. This is generally not true for plural-hull sailing craft as the generally more slender hulls have lower drag at their theoretical speed limits, which limits are reached while the relatively larger sails still have sufficient force to overcome the increased drag.

However, the very design characteristics which account for shallow draft, high speed and good lateral stability—widely separated, slender, shallow draft hulls, large sail areas and relatively light overall weight—cause plural-hull craft to be extremely difficult to maneuver, particularly in putting about, to be longitudinally unstable and to be subject to sideways drift.

Monohull sailing craft tend to pivot about a vertical axis at the center of lateral resistance in turning and consequently are easily turned. However, each of the several hulls of plural-hull craft has its own center of lateral resistance about which the craft cannot simultaneously pivot. A compromise is struck, and the craft is said to pivot about the bow of one hull and to drag the remaining hulls through the turn. The sideways dragging of hulls causes considerable resistance to turning, this resistance increasing with the number of hulls and with increased hull separation.

In putting about through the wind to change tack, all craft operating under sail power alone depend upon forward momentum to carry them through the turn. Because of their large resistance to turning and their comparatively light weight, and hence comparatively lower forward momentum, many plural-hull sailing craft are difficult or impossible to put about without auxiliary power. This is a serious disadvantage of this type of craft.

Another serious disadvantage of most popular plural-hull sailing craft is their susceptibility to capsizing diagonally forward under large longitudinal sail forces which drive the bows of leeward hulls under water. This is particularly the case when simultaneous large lateral sail forces put most or all of the craft's weight on leeward hulls by flying the windward hulls. This susceptibility is caused by the use of relatively lower displacement hulls and relatively large sails on this type of craft.

Forward capsizing is not of serious concern in modern monohull sailing craft, for most sea conditions, because lateral sail forces, usually several times greater than longitudinal sail forces, are normally the limiting factor. Thus, if the amount of sail carried is insufficient to cause monohull craft to capsize sideways, it is generally too small to cause them to capsize forward; although, it was not unheard of for tall masted clipper ships to be driven bow first under water in a gale by use of too much sail.

A third, less serious, defect of most plural-hull craft, is their tendency to drift sideways under lateral wind forces because of the relatively low resistance to drift of their shallow draft, keelless hulls.

Improving maneuverability of plural-hull sailing craft by shortening hulls, using extreme rocker (longitudinal upward curving of hulls), and spacing hulls closer together, decreasing sideways drift by adding keels or using asymmetrical hulls, and improving longitudinal stability by increasing hull buoyancy and reducing sail area causes corresponding reduction of advantageous lateral stability, speed and shallow draft. Thus, the prior art has attempted to effect improvements in alternative manners.

Quadra-hull craft have been designed (e.g. Dismukes, U.S. Pat. No. 3,316,873, and Hamilton, U.S. Pat. No. 3,265,026) which are equivalent to craft formed by cutting both hulls of a catamaran in two along a transverse plane and spacing the hull segments longitudinally apart. Although longitudinal stability tends to be improved, in much the same manner as lateral hull separation improves lateral stability, water drag is considerably increased because of wave interference between the in-line hulls. Also, the number of hulls which must be driven past their theoretical hull speed limit, if reasonably high speeds are to be achieved, is doubled, as is the increased hull drag. These disadvantages are continuously present, even when wind forces do not require increased longitudinal stability.

Other designs (e.g. Barkla, U.S. Pat. No. 2,804,038) have added horizontal planes to the bows of forward hulls to provide additional bow lift to prevent bow submergence. Some (e.g. Fletcher, U.S. Pat. No. 2,238,464) have hinged forward hulls about transverse axes so the hulls may conform to wave motion to help prevent swamping by oncoming waves. However, such hull designs increase water drag under all sailing conditions, regardless of the need for additional longitudinal stability.

Some designs (e.g. Berge, U.S. Pat. No. 2,944,505 and McIntyre, U.S. Pat. No. 2,106,432), when sailing with the wind or on broad reaches, use an inclined sail to create a lifting force to counter the forces tending to drive the bows under water. This, however, is accomplished at a sacrifice of forward driving power.

Many plural-hull craft, often catamarans, outrigger canoes or proas, are designed with complete fore and aft symmetry (e.g. Smith, U.S. Pat. No. 3,295,487 and Laurent, U.S. Pat. No. 3,173,395) to circumvent maneuverability problems. Instead of pulling about to assume a new tack, the sail is manually repositioned and the craft is "backed" into a new heading, the previous stern now acting as the bow and vice versa. Fore and aft symmetry is not, however, good hull or sail design, and performance is sacrificed under all sailing conditions, even when no maneuvering is required.

Some trimarans have been designed with horizontally rotatable hulls so the craft may be "skewed" onto a new heading rather than having to be put about (e.g. Henderson, U.S. Pat. No. 1,303,839 and Twining, U.S. Pat. No. 606,104). Individual hull rotation has sometimes been provided so that a hull or hulls may function as rudders (e.g. Creed, U.S. Pat. No. 1,422,542, Malrose, U.S. Pat. No. 3,112,725 and Lake, U.S. Pat. No. 1,846,602). Such craft are, however, not designed to improve longitudinal stability, and consequently sail area, and hence speed, cannot be maximized.

Resistance to sideways drift is often provided by centerboards (e.g. White, U.S. Pat. No. 3,223,064) or inclined planes (e.g. McIntyre, U.S. Pat. No. 1,356,300). However these, unless large, are relatively ineffective in reducing sideways drift and they increase draft. If they are large, weight and draft of the craft may be considerably increased.

Accordingly, it is an object of the present invention to obtain advantages of plural-hull craft while minimizing their disadvantages.

SUMMARY OF THE INVENTION

In carrying out the principles of the present invention, according to a preferred embodiment, a plural-hull craft comprises means for increasing the buoyancy of a leeward hull, whether the wind is from port or starboard, without turning the craft end for end, so as to improve longitudinal stability. This means for increasing leeward hull buoyancy includes shifting a third hull into substantial longitudinal alignment with whichever of a port and starboard hull is leeward. Means are provided to streamline the adjacent bow and stern of aligned hulls to establish substantial hydrodynamic continuity of the aligned hulls and form a "composite leeward hull". Means are provided for counterrotating aligned hulls into the approximation of an arc for ease in turning, or into the approximation of a cambered airfoil to provide sideways hull lift to counteract hull drift.

More specifically, in one embodiment of the invention, a first or port hull, a second or starboard hull, and a third hull are pivotally attached to an interconnect spider in mutual spaced relationship. Control means are provided for rotating each hull, individually or in unison, in a generally horizontal plane about pivotal attachment points, such that the third hull may be substantially longitudinally aligned astern of whichever of the port and starboard hulls is leeward. The configuration of the interconnect spider is such that the bow of the third hull and the stern of the leeward port or starboard hull (with which the third hull is aligned) are in close proximity to each other.

Means are additionally provided for achieving substantial hydrodynamic continuity between aligned hulls by use of conjugate shapes at the stern of port and starboard hulls and at the bow of the third hull. Alternatively, a fairing means is provided to enclose the stern of the aligned port or starboard hull and the bow of the third hull, whereby this region is streamlined to the flow of water. The aligned leeward hulls are thus formed into a composite leeward hull.

BRIEF DESCRIPTION OF THE DRAWINGS

FIG. 11 is an exploded perspective view showing longitudinally aligned hulls with conjugate surfaces;

FIG. 12 is a fragmentary elevation view showing longitudinally aligned hulls with conjugate surfaces;

FIG. 13 is an exploded perspective view, showing an alternative method of streamlining the bow and stern region of longitudinally aligned hulls by use of a fairing;

FIG. 14 is a perspective view showing enclosure of the bow of the trailing hull in the stern fairing of a port or starboard hull; and FIG. 15 is a fragmentary top plan view, showing deflection of the port or starboard hull stern fairing by the bow of the trailing hull as it comes into longitudinal alignment.

DESCRIPTION OF THE PREFERRED EMBODIMENT

General Description

Figure 1:
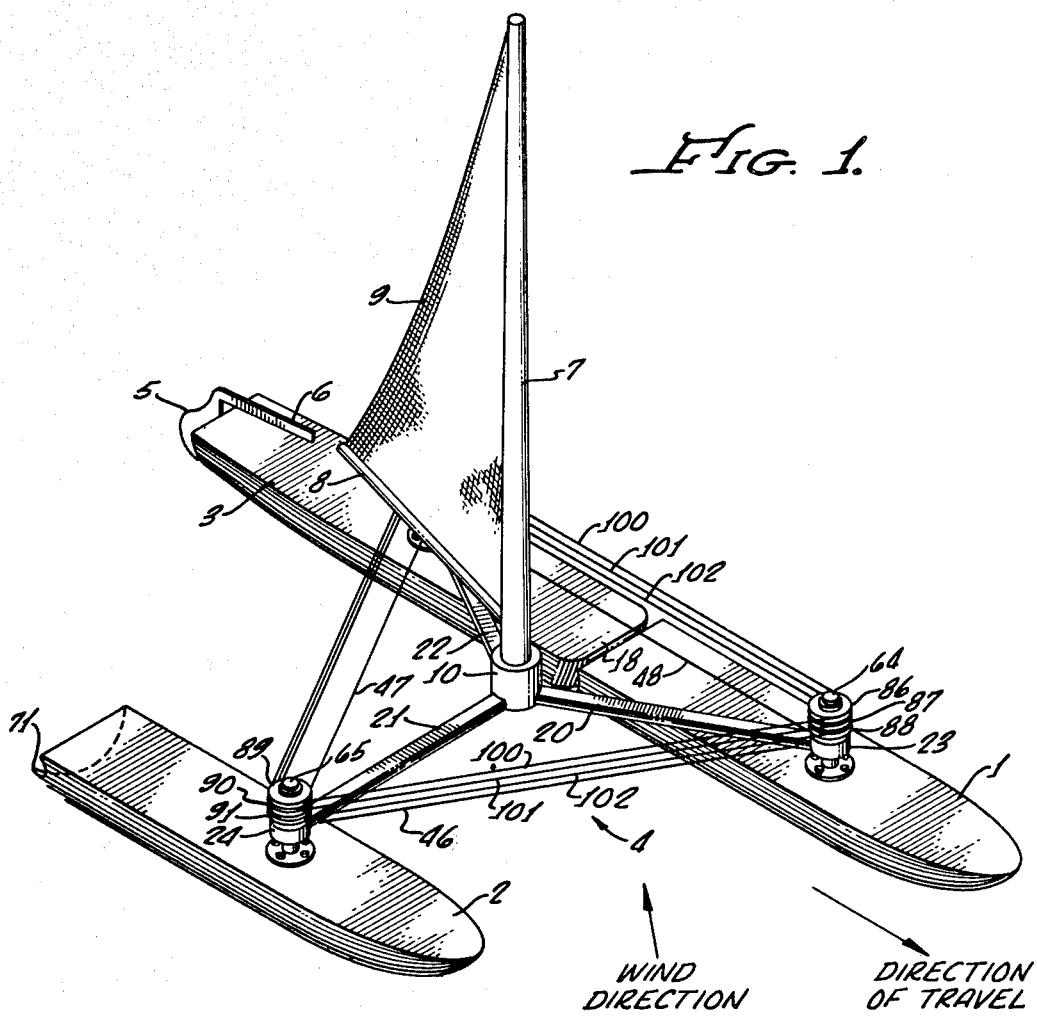
FIG. 1 is a perspective view of the preferred embodiment, showing longitudinal alignment of hulls 1 and 3 and a Y-shaped spider.
Figure 2:
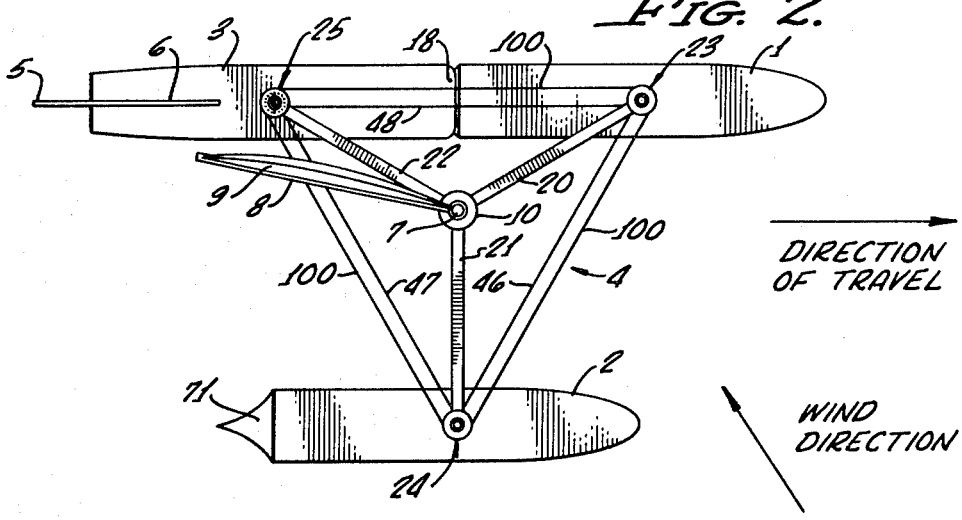
FIG. 2 is a top plan view of the embodiment of FIG. 1.

A preferred embodiment of the invention, illustrated in FIGS. 1 and 2, comprises a first (or port) hull 1, a second (or starboard) hull 2, and a third (or trailing or after) hull 3, maintained in mutual spaced relationship by a rigid Y-shaped interconnect spider 4, to which hulls 1, 2 and 3 are pivotally attached at their approximate centers of lateral resistance.

Figure 5:
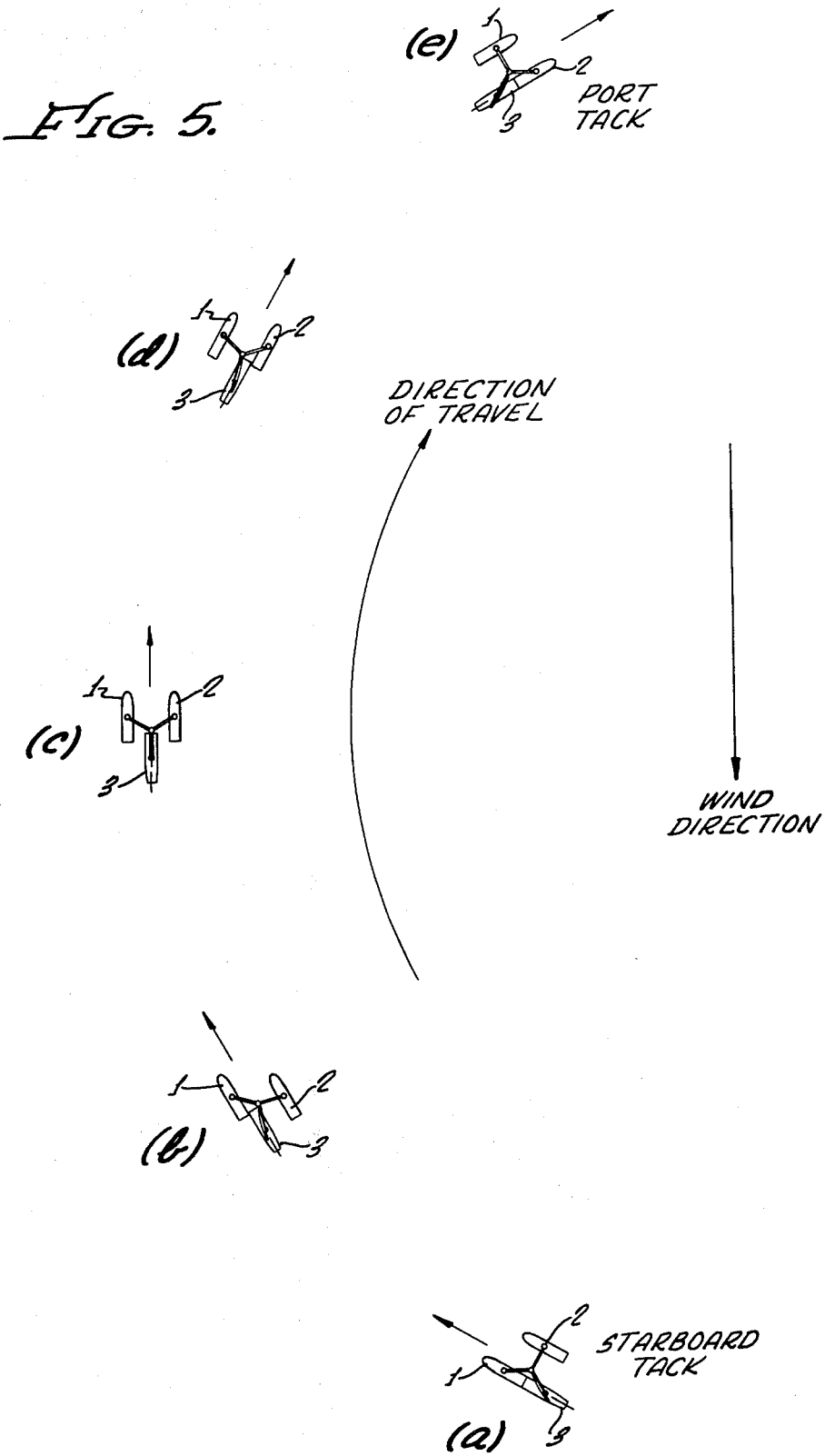
FIG. 5 is a top plan view, depicting a sequence of changes of hull rotation as the craft changes from a starboard to a port tack.

Hulls 1, 2 and 3, which are each buoyant structures, are rotatable on spider 4, in a generally horizontal plane, such that trailing hull 3 may be brought into substantial longitudinal alignment with whichever port or starboard hull 1 or 2 is leeward, according to wind direction (with the three hulls mutually parallel), to increase leeward hull buoyancy and improve longitudinal stability. FIGS. 1 and 2 show longitudinal alignment of hull 3 with port hull 1, the latter of which is the leeward of hulls 1 and 2, the wind being from the starboard direction. Similarly, when the wind is from the port direction, hull 3 may be aligned astern of starboard hull 2, the latter of which is then the leeward of hulls 1 and 2. FIG. 5 depicts, in a series of several diagrams, the transition from the former alignment (i.e., hulls 1 and 3 aligned) to the latter configuration (i.e. hulls 2 and 3 aligned) as the craft changes tack through the wind, that is, as the wind direction relative to the craft changes from starboard to port.

The configuration of spider 4 is such that when hull 3 is longitudinally aligned astern of either hull 1 or 2, the bow of hull 3 is in close proximity with the stern of hull 1 or 2. In addition, in the preferred embodiment, illustrated in FIGS. 1, 11 and 12, the sterns of hull 1 and 2 and the bow of hull 3 are of conjugate shapes. This conjugate shaping, in conjunction with fore and aft design of hulls 1 and 2 and hull 3 which continues the fore and aft lines of hulls 1 and 2 into hull 3, creates a proximate extension forming a substantially hydrodynamically continuous structure of the longitudinally aligned hulls, thereby streamlining the flow of water around the aligned hulls in the region of adjacency and considerably reducing water drag.

The shifting of hull 3 into longitudinal alignment with the leeward of the port and starboard hulls creates what will be referred to hereinafter as a "composite leeward hull" which was substantially the characteristics of a single hull with a buoyancy equal to the combined buoyancy of hull 1 or 2 and hull 3 and a length equal to the combined length of hull 1 or 2 and hull 3. In the preferred embodiment each hull is substantially the same size; thus, the composite leeward hull has two thirds the buoyancy of the entire craft, and a length double that of the windward hull (hull 1 or 2).

This configuration of the craft with a long composite leeward hull laterally separated from a shorter windward hull, whose center is opposite that of the composite leeward hull, is very similar to that of a proa (a fast outrigger-type craft having laterally spaced, parallel hulls of different lengths to avoid wave interference between hulls). It has the advantageous speed and longitudinal stability of a proa without its disadvantage of having to be turned around, end for end (letting the former bow become the new stern and the former stern become the new bow), to maintain greater buoyancy on the leeward hull as course directions are changed through the wind. To put about (as more fully described below), it is merely necessary to shift hull 3 from a position astern of one forward hull to a position astern of the other forward hull; consequently, it is unnecessary to have the inefficient fore-aft symmetry of a proa.

The longer leeward hull with increased hull buoyancy increases greatly the craft's resistance to forward capsizing under longitudinal forces which tend to drive the bow of the leeward of the port or starboard hull under water. Whereas, for example, a typical catamaran has only half the total hull buoyancy in the leeward hull, the preferred embodiment has substantially two-thirds of the entire hull buoyancy in the leeward hull to prevent forward capsizing. Additionally, whereas in a catamaran, when the windward hull is flown by strong lateral sail forces, the weight (ignoring the crew) on the leeward hull, tending to submerge it, is doubled, in the preferred embodiment the weight on the leeward hull is increased by only fifty percent.

An additional important advantage is that the composite leeward hull, with double the length of the leeward port or starboard hull, has reduced high speed drag and inter-hull wave interference drag due to its longer, relatively more slender, structure. Thus, speedwise, the craft is comparable to a proa, one of the fastest sailing craft.

In the aligned configuration, steering may be by means of a rudder 5, conventionally attached at the vertical centerline of the hull 3 stern, as by gudgeons and pintles (not shown). Rudder 5 is controlled by a conventional tiller 6, attached at one end to an upper projection of the rudder and extending forward along the longitudinal axis of hull 3, whereby a crew member may easily move the rudder to steer the craft. It should be noted, however, that any of a variety of means may be employed to move the rudder, including, for example, cables and a control wheel, without exceeding the scope of the invention.

Figure 6:
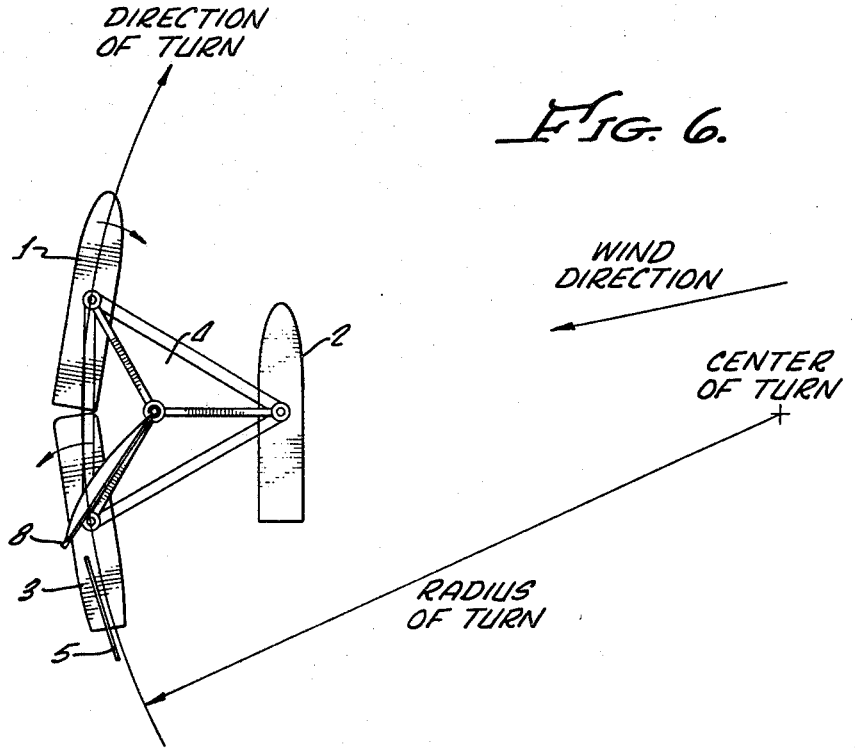
FIG. 6 is a top plan view, showing longitudinally aligned hulls counterrotated equally to turn the craft.

The preferred embodiment, by virtue of its rotatable hulls, has the additional very advantageous feature of being able to turn by, in effect, "bending" the composite leeward hull, comprised, as described, of aligned hulls 1 or 2 and hull 3, into an approximation of an arc whose center is at the approximate center of the desired turn radius. This is accomplished, as depicted in FIG. 6 for a starboard turn, by counterrotating hull 1 or 2 and aligned hull 3 through substantially equal arcs in such direction that the bows and sterns of both hulls are on the radius of the turn. In this configuration a turn may easily be made, as the two leeward hulls are steered, rather than dragged, through the turn. In a similar manner, a turn to port may be made, and similar turns may be made with hulls 2 and 3 aligned.

Figure 7:
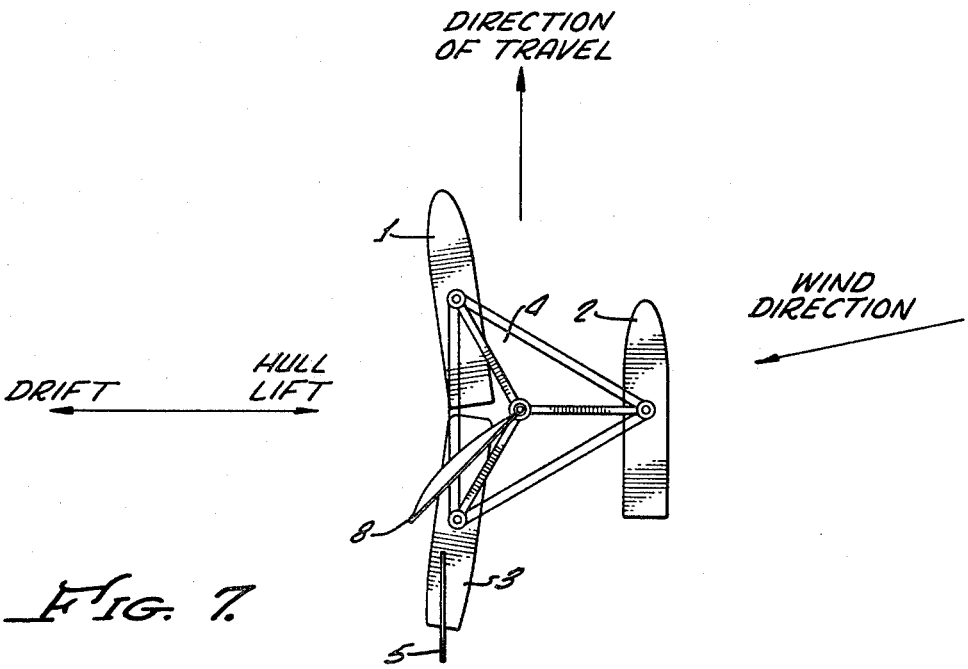
FIG. 7 is a top plan view, showing longitudinally aligned hulls counterrotated through unequal angles to combat drift.

Sideways drift of the craft, always a problem when shallow draft hulls are used, as they are in plural hull craft, may be prevented by counterrotating the aligned hulls (as depicted in FIG. 7 for aligned hulls 1 and 3) to "bend" the composite leeward hull into a configuration similar to that of a vertical hydrofoil or cambered airfoil. This creates a "lift" directed horizontally sideways in a direction opposing drift. The adjacent bow and stern of aligned hulls are rotated to windward, with the leading hull 1 or 2 being rotated equally or less than hull 3 (if rotated less than hull 3, a tendency of the craft to turn is reduced). The angles of rotation of each hull may be adjusted to create an equilibrium condition wherein sideways drift is exactly countered by the sideways hull lift. Although there is some added water drag in this configuration with the hulls out of alignment, the cambered airfoil shape has a high lift to drag ratio (without the added drag of, for example, asymmetrical hulls sometimes used to overcome drift). Loss of forward speed is thereby minimized, and this slight loss of speed occurs only when the hulls are rotated to the airfoil configuration.

Any tendency of the craft to turn or change course as a result of the airfoil type hull configuration may be countered not only by unequal angles of hull rotation but also by use of rudder 5, or by use of sail.

The preferred embodiment, exemplifying a small craft, employs a single Marconi-rigged mainsail comprising a conventional, vertical mast 7, and boom 8 and a triangular sail 9, assembled in a conventional manner. Mast 7 is stepped in a hub 10 which is substantially at the center of spider 4. As a result, the center of sail effort is advantageously located slightly aft of the center of buoyancy of the composite leeward hull for most wind directions, thereby providing easier steering and additional resistance to forward capsizing (FIGS. 1 and 2).

It will be appreciated, however, that any of a variety of sail systems may be used. Auxiliary sails, such as jibs and staysails may be added, or a lateen or gaff-rigged mainsail or sails may be employed, as may plural mainsails or any combination of mainsails and auxiliary sails, rigged on single or plural masts located on the hulls or interconnect spider or both, without violating the spirit of the invention.

Figure 3:
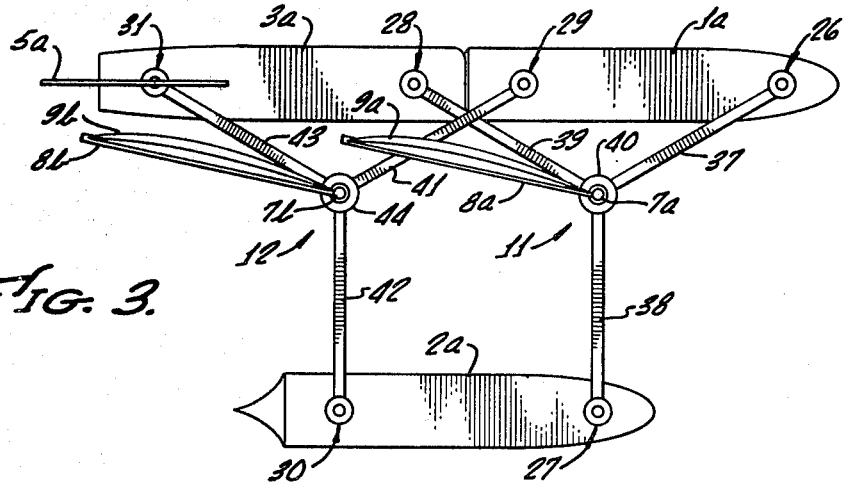
FIG. 3 is a top plan view of a variation of FIG. 1, showing use of dual Y-shaped spiders.
Figure 4:
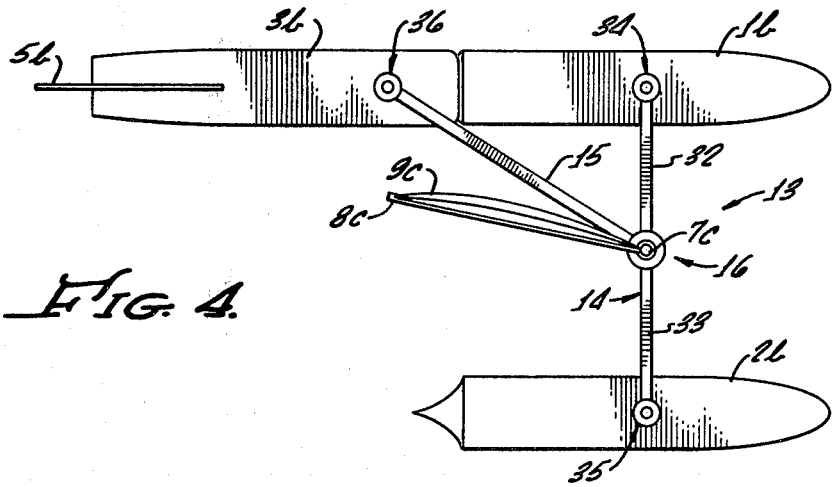
FIG. 4 is a top plan view of a second variation of FIG. 1, showing use of a T-shaped spider.

FIGS. 3 and 4 illustrate two of the many possible variations of the hull interconnect spider which is instrumental in providing the principal feature of significantly increasing leeward hull buoyancy, by hull rotation, to greatly increase longitudinal stability, regardless of the wind direction and without necessity of reversing the craft.

FIG. 3 illustrates use of two Y-shaped spiders, a forward spider 11 and an aft spider 12 and exemplifies use of plural interconnect spiders. The bows of hulls 1*a*, 2*a* and 3*a* (corresponding to hulls 1, 2 and 3 previously described) are pivotally attached to the extremities of spider 11, while the hull sterns are pivotally attached to the extremities of spider 12. The hull attachments and the spiders are such that the hulls are mutually parallel and are constrained to move in parallel unison during rotation relative to the spiders.

Hulls 1*a*, 2*a* and 3*a* may be rotated relative to spiders 11 and 12 to achieve longitudinal alignment, in close proximity, of hull 3*a* with whichever of port or starboard hull 1*a* or 2*a* is leeward. Spider 11 is lower than spider 12 to allow spider 12 to pass above spider 11 to prevent rotational interference between the two spiders.

The principal advantage of a plural hull interconnect structure is that each hull has two or more pivotal attachments; hence, the hulls are more securely and rigidly attached to the interconnecting structure. In addition, parallel rotation of all hulls through equal angles is guaranteed. Also, each individual spider may be made structurally lighter than is possible where only a single spider is used.

The principal disadvantage of using plural interconnect spiders is that the hulls cannot easily be made individually rotatable. Some relative hull rotation may be provided by hinging the arms of spiders 11 and 12 at their central ends; however, this adds cost and complexity and weakens the structure of the spiders. Steering of such a craft may still be accomplished without relative hull rotation by conventional use of a rudder 5*a* and sideways drift may be countered by use of conventional centerboards (not shown).

By using dual interconnect spiders, two sets of Marconi-rigged mainsails, similar to that used in the preferred embodiment, may be provided. For example, a mast 7*a* (carrying a boom 8*a* and sail 9*a*) may be stepped on forward spider 11 and a mast 7*b* (carrying a boom 8*b* and a sail 9*b*) may be stepped on aft spider 12. It is evident that alternative types of sail arrangement may also be employed, such as a mainsail on spider 12 and a jib, Genoa or spinnaker on spider 11, all sail variations being encompassed by the invention.

FIG. 4 exemplifies a second variation of the preferred embodiment wherein a trailing or after hull 3*b* may be positioned in longitudinal alignment and in close proximity astern of whichever of a port or starboard hull 1*b* or 2*b* is leeward (hulls 1*b*, 2*b* and 3*b* being similar to hulls 1, 2 and 3). Such positioning is by a combination of horizontal translation and rotation of only the hull 3*b*. Hulls 1*b* and 2*b* then remain in static positions at the extremities of an interconnect spider 13 (having a cross member 14 and a trailing member 15.) to allow hub 3*b* to trail in the direction of travel as it is shifted into alignment, hull 3*b* is pivotally attached at its bow to the aft end of member 15, which in turn is pivotally attached at its opposite end to a central hub 16 of cross member 14. Member 15 is thus free to pivot either port or starboard in a substantially horizontal plane so that hull 3*b* may be shifted into alignment with either hull 1*b* or hull 2*b*.

A major advantage of such an interconnect spider is that strong, rigid attachment of hulls 1*b* and 2*b* to cross member 14 may be provided, particularly if member 14 is made wide and hulls 1*b* and 2*b* are attached at more than one point. Also, trailing member 15 need not be large, and may in fact be flexible if alternative means, such as ropes and cleats, are provided for securing aligned hulls together into a composite leeward hull.

A disadvantage of spider 13, however, is that regardless of the alignment of hull 3*b*, the port and starboard hulls 1*b* and 2*b* remain at all times abreast of each other, rather than the windward hull being shifted aft to be centered abreast of the composite leeward hull as it is in the preferred embodiment. The windward hull, when flown by lateral forces, will thus exert a torque on the leeward hull tending to submerge its blow. Also alinged hull counterrotation to change course or to counter drift is not possible unless hulls 1*b* and 2*b* are pivotally attached to crossmember 14 (thereby losing the principal advantage). Steering may, however, be accomplished by rotation of hull 3*b* or by use of a rudder 5*b* and drift may be countered in a conventional manner, such as by use of a centerboard (not shown).

Another disadvantage is that if a mainsail 9*c* (supported by a mast 7*c* and a boom 8*c*) is carried on crossmember 14, as seen in FIG. 4, the center of sail effort will also be further forward than desirable for optimum longitudinal stability and ease of turning.

It will be understood from the foregoing illustrative examples that many varieties and designs of interconnected spiders may be employed to interconnect plural hulls in such a manner that a third hull may be shifted by some means, for example, by rotation or translation, or a combination of both, into substantial longitudinal alignment with whichever of a first or port and a second or starboard hull is leeward. In addition, the interconnect spider need not interconnect all hulls, it need interconnect only a port and starboard hull, as does, for example, crossmember 14 in FIG. 4. The third hull which can be aligned with either leeward port or starboard hull may thus include, for example, a detachable hull segment bolted to the bow or stern of the port or starboard hull, and which may be unbolted and carried or moved by some means to the opposite hull and attached thereto when that opposite hull becomes the leeward hull. This third hull may alternatively comprise, for example, inflatable hull sections, either permanently attached to a hull or moveable. All such variations are within the scope of the invention.

DESCRIPTION OF SPECIFIC ELEMENTS

(a) Hulls

Hulls 1, 2 and 3 (hull 1 including hulls 1*a* and *b*, hull 2 including hulls 2*a* and 2*b* and hull 3 including hulls 3*a* and 3*b*) are of generally conventional design, and are of a size and construction appropriate for plural hull craft. They are of unidirectional, nonsymmetrical fore and aft construction for minimum drag, there being no necessity for changing sailing direction by reversing the hulls end for end. The hulls are preferably fabricated from a strong lightweight material such as wood, plywood, fiberglass or aluminum. Hulls 1 and 2 and hull 3 are so constructed that when hull 3 is longitudinally aligned astern of either hull 1 or 2, the fore and aft contours of hulls 1 or 2 are continued into hull 3, thereby forming a low drag, substantially hydrodynamically continuous structure. As seen in FIGS. 1, 11 and 12, a structure 17 on the sterns of hulls 1 and 2 is complementary to a structure 18 on the bow of hull 3 to achieve a streamlined water flow around the adjacent stern-bow region to further minimize water drag and maximize speed of the craft. To this end the hull 3 bow and the sterns of hulls 1 and 2 are preferably blunt with structure 18 being vertically convex downward for streamlining in nonaligned configurations. The structure 17 on hulls 1 and 2 is shaped conjugate to the curvature of structure 18 of hull 3.

However, a variety of curved surfaces may be employed on the appropriate bow and sterns to achieve this conjugate shaping, the only limitation being that hull 3 be capable of moving into position behind hull 1 or 2 without interference between hulls. It will be understood, however, that such hull interference during alignment may be avoided as by relative vertical movement between the hull 3 bow and hull 1 or 2 stern during the alignment procedure, instead of, or in addition to, appropriate design of the mating surfaces.

An alternate method of achieving substantial hydrodynamic continuity of the mating region of longitudinally aligned hulls employs a flexible fairing 19 which is attached at an extreme stern 17*a* of bluntly terminated hulls 1*c* 2*c*, and into which the fore and aft contours of the hulls are continued (FIGS. 13, 14 and 15). The length of the fairing is sufficient to enclose a streamlined bow 18*a* of hull 3*c* when hull 3*c* is longitudinally aligned astern of hull 1*c* or 2*c* (FIG. 14), but is not so long that the bow 18*a* may not flex it aside and enter it has hull 3*c* swings into alignment. Fairing 19 is generally of an extended U-shape, open at the top for greater flexibility. It is constructed of a relatively stiff, yet pliable, material such as rubber, neoprene or soft plastic.

Fairing 19 is, however, merely exemplary of one type of fairing which may be used to achieve substantial hydrodynamic continuity of aligned hulls. Other types of fairings, either flexible or rigid, fixed, movable or removable, and preformed or inflatable, may be employed to achieve the stated objective without departing from principles of the invention.

(b) Interconnect Spiders

As above described, the preferred embodiment, illustrative of merely one type and configuration of hull interconnect means, employs a rigid Y-shaped spider 4 comprising three arms 20, 21 and 22 (FIG. 1). These arms are of substantially identical length and radiate, equally spaced, from central hub 10. They terminate in pivotal hull attachment points or bearing hubs 23, 24 and 25, respectively. Hub 23 is at the attachment point for hull 1, hub 24, for hull 2, and hub 25, for hull 3.

The dual spider illustrated in FIG. 3 comprises two Y-shaped spiders 11 and 12 which are substantially identical to spider 4. Thus, any description of spider 4 is to be considered equally applicable to spiders 11 and 12, except that because two interconnect spiders are used, spiders 11 and 12 may be structurally lighter than spider 4 without substantial loss of overall interconnect strength, and except that spider 11 includes attachment points or bearing hubs 26, 27 and 28, for attaching, respectively, the bows of hulls 1*a*, 2*a* and 3*a*, and spider 12 includes attachment points or bearing hubs 29, 30 and 31, for attaching, respectively, the sterns of hulls 1*a*, 2*a* and 3*a*.

Interconnect spider 13 comprises cross member 14 and trailing member 15 (FIG. 4). Cross member 14, comprising an arm 32 and an arm 33, (both in line and each attached at one end to hub 16) nonrotatably attaches to hulls 1*b* and 2*b* at flanges 34 and 35, respectively, flange 34 being at the end of arm 32 and flange 35 being at the end of arm 33. The trailing end of member 15 is rotatably attached to the general bow region of hull 3*b* by a bearing hub 36.

All spiders illustrated in FIGS. 1–4 share many common characteristics, spiders 4, 11 and 12 having already been described as substantially identical.

Spider 11 comprises arms 37, 38 and 39 radiating, equally spaced, from a central hub 40. Spider 12 comprises arms 41, 42 and 43 radiating equally spaced, from a central hub 44. Arms 20, 21 and 22 of spider 4, arms 37, 38 and 39 of spider 11 and arms 41, 42 and 43 of spider 12 are long and relatively slender, preferably with hollow, tubular cross sections for lightness and strength. Central hubs 10, 40 and 44 of spiders 4, 11 and 12, respectively, are relatively large, solid, vertical cylinders axially bored to a sufficient depth to receive securely the foot of sail masts 7, 7*a* and 7*b*, respectively. The three radiating arms of each spider are secured to the central hubs, as by welding, preferably in a manner to create a generally planar spider; although, the spider need not be planar, but may, for example, be arched upward to provide greater wave clearance.

Bearing hubs 23, 24 and 25 of spider 4, bearing hubs 26, 27 and 28 of spider 11 and bearing hubs 29, 30 and 31 of spider 12 are identical and are of vertical cylindrical shape. They are attached, as by welding, to the free end of the appropriate spider arm. The hulls are pivotally attached to the spider at these bearing hubs in a manner described below.

Cross member 14 of spider 13 is constructed in a manner similar to spider 4 except that it has only two substantially horizontal arms, 32 and 33, radiating from a hub 16, which is similar to hub 10 of spider 4. The ends of arms 32 and 33 are generally vertical and terminate in flanges 34 and 35, for nonrotatably mounting hulls 1*b* and 2*b* respectively, although pivotal mounting of hulls 1*b* and 2*b* is within the scope of the invention.

Regardless of the type spider utilized to interconnect the three hulls, the spider must be sufficiently strong to withstand the considerable stresses resulting from combined sail and hull forces. It thus must be strong in both bending and torsion. In small craft, exemplified in the preferred embodiment and its variations, the various spider arms and members are preferably constructed of a strong, lightweight material such as aluminum tubing; however, larger craft will require correspondingly stronger spiders.

(c) Sails and Sail Supports

As previously described, the preferred embodiment and its illustrated variations employ a single Marconi-rigged sail comprising mast 7 (including 7*a*, 7*b* and 7*c*) and boom 8 (including 8*a*, 8*b* and 8*c*) and sail 9 (including 9*a*, 9*b* and 9*c*) supported thereby (FIGS. 1–4). Conventional mast and sail rigging, not shown, are utilized.

The sail support must be sufficiently strong to withstand sail forces in combination with hull and spider movement. For small craft, as exemplified in the preferred embodiment, the foot of mast 7 is stepped into a hole in a central hub, typified by hub 10 of spider 4. Conventional mast stays, not shown, may be attached from the extremities of the interconnect spider to the top of the sail mast and may be of a permanent type if the boom 8 is shorter than the length of spider arms or members, or may be of a removable type if the boom is longer.

As there is a difficulty in installing mast stays on plural spiders whose arms are overlapped (as shown for arm 39 in FIG. 3), it is more appropriate that the forward spiders carry small sails requiring no mast staying.

This invention also encompasses sail support variations such as plural masts, stepped generally at the extremities of the interconnect spider and inclined to meet at their heads, or plural sails, including combinations of mainsails and auxiliary sails on either plural or single masts, stays or bowsprits, wherever and however located on the spider(s) or on the hulls. It also encompasses, in a craft with more than one spider, an interconnect structure between spiders and the mounting of single or plural masts and single or plural sails on such interspider structure.

(d) Deck

Figure 8:
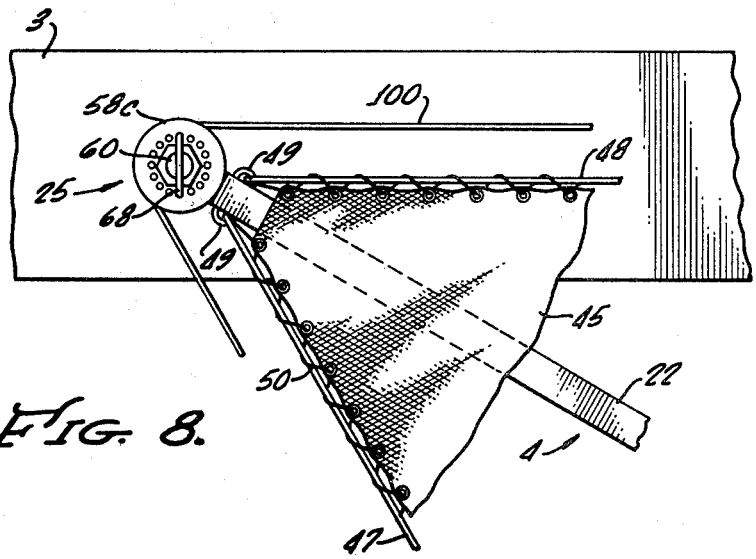
FIG. 8 is a fragmentary top plan view of the arrangement of FIG. 2 showing hull attachment and deck.

The preferred embodiment employs a simple crew support, as best seen in FIG. 8, comprising a deck 45, made of some strong fabric, such as canvas or duck, mounted generally over spider 4 and is therefore, generally triangular in outline. Deck 45 is supported along its outer edges as by cables 46, 47 and 48 which run between the outer ends of spider arms 20, 21 and 22, respectively, and which are attached at their ends to the spider arms, as by eyes 49 (FIGS. 1, 2, 8 and 9). The edges of deck 45 are laced to cables 46, 47 and 48 by a lace 50 to stretch the deck tautly over spider 4, the spider also providing some support. A central cutout, not shown, is provided in the deck for clearance for mast 7 and central hub 10.

Other deck materials, either fabric or nonfabric, and either flexible or rigid, may however be used, as may configurations other than triangular. The invention encompasses as well use of depending and superstructures as will not interfere with the objectives of the invention.

(e) Hull Controls

Figure 9:
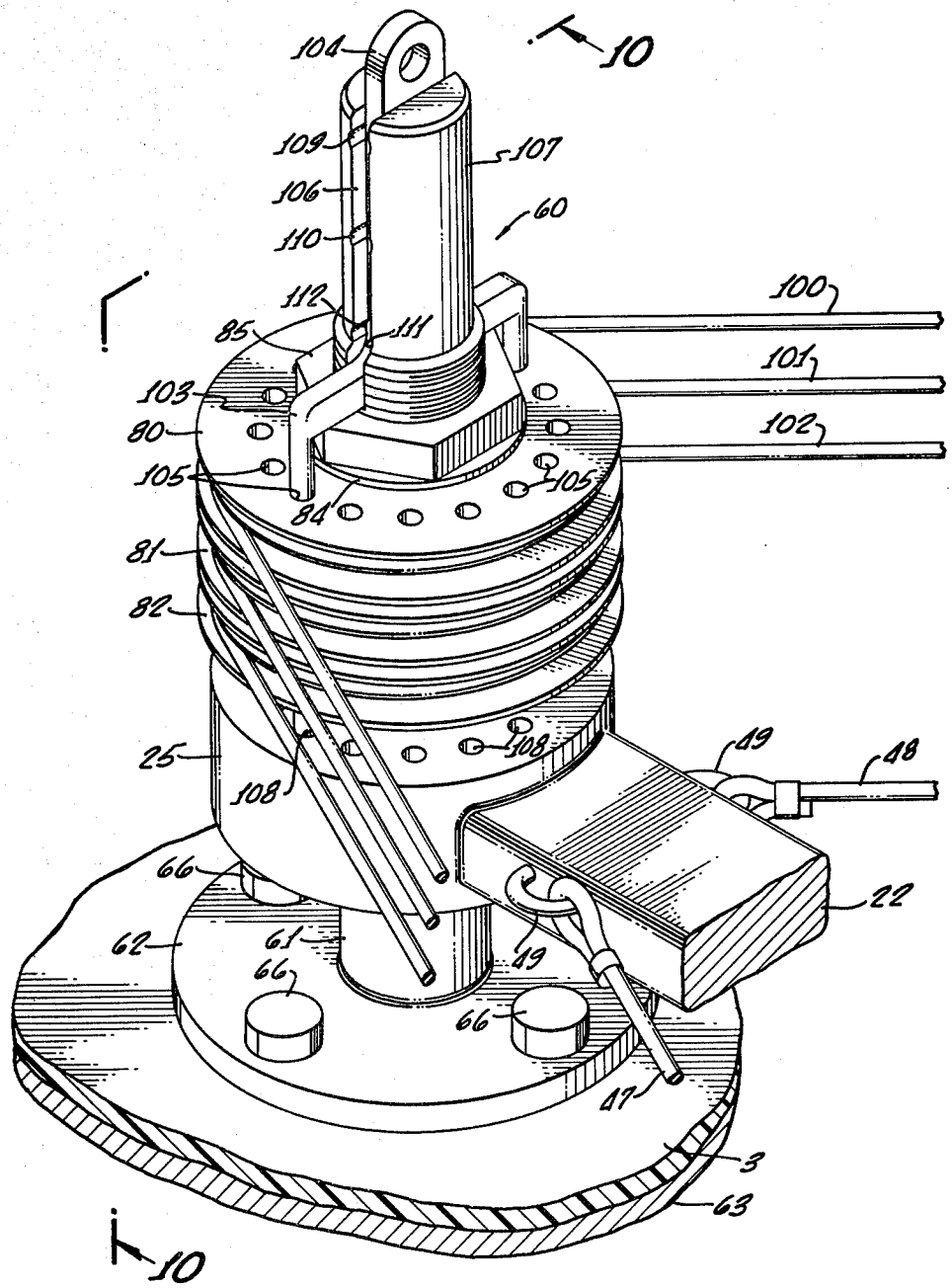
FIG. 9 is a perspective view showing hull attachment and controls.
Figure 10:
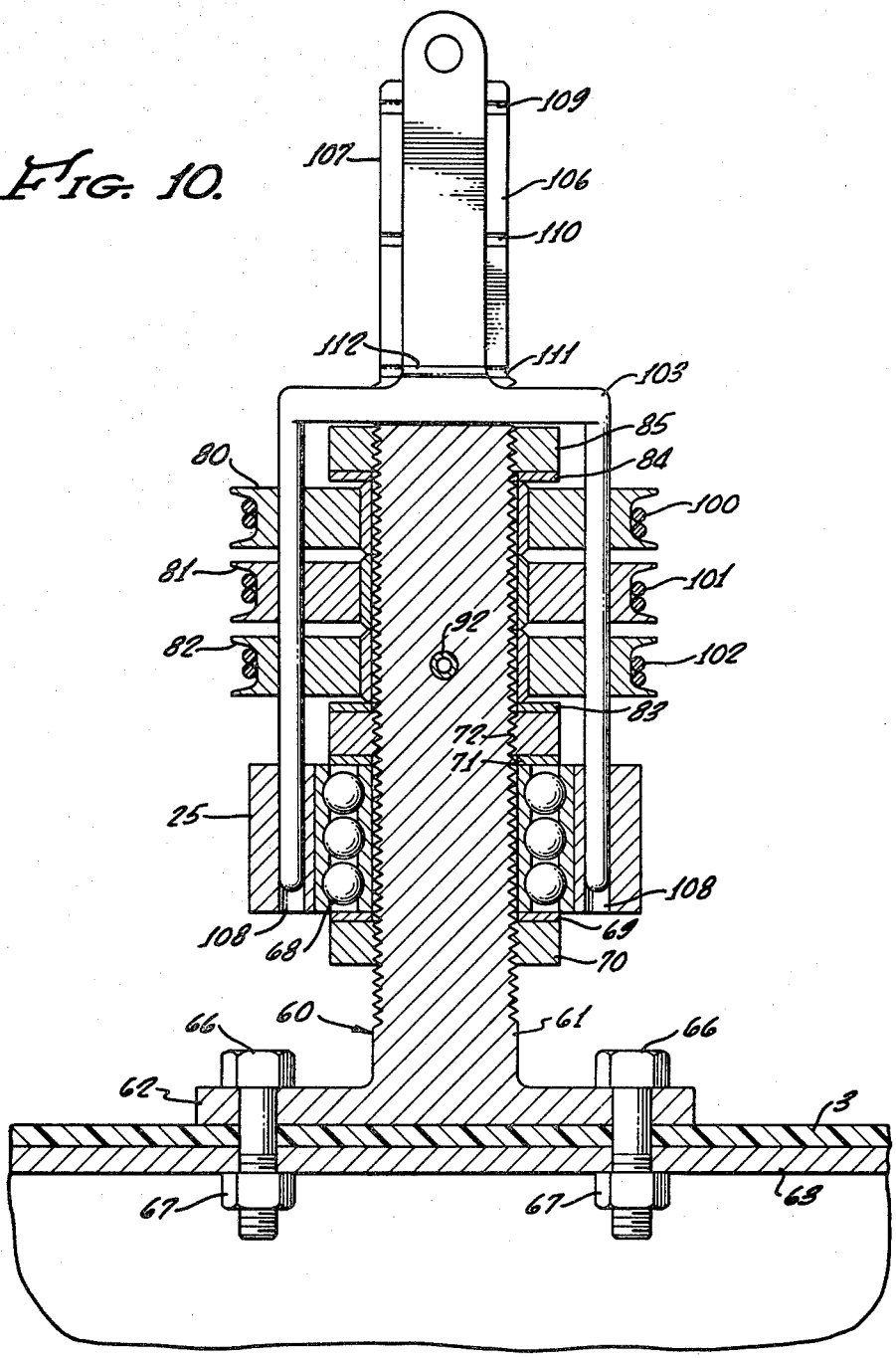
FIG. 10 is a vertical section view along line 10—10 of FIG. 9, showing hull attachment and controls.

FIGS. 9 and 10 illustrate one manner in which hulls 1, 2 and 3 may be pivotally attached to spider 4 and one manner in which rotation of these hulls about their pivotal attachment points may be achieved. These figures and the ensuing description are merely illustrative of one of the possible pivotal hull attachments and controls encompassed by this invention.

FIGS. 9 and 10 and the accompanying description illustrate and describe the attachment of hull 3 to spider 4 and the method of hull rotation at hull 3. The Figures and description, however, also pertain, unless otherwise noted, to the similar attachment and controls for other pivotally attached hulls.

A pivotal axle 60 comprises a vertical cylindrical shaft 61, threaded for substantially its entire height, terminating at its lower end in a flange 62. Flange 62, of large diameter, is securely attached to a structural hull member 63, at substantially the center of hull 3 lateral resistance. (Similar axles 64 and 65 are attached to hull 1 and hull 2, respectively, as seen in FIG. 1) Attachment of flange 62 to member 63 is by use of several bolts 66 and nuts 67. This hull attachment must be strong, and axle and flange sizes may be correspondingly increased as hull size is increased. Axles 60, 64 and 65 are preferably made of a strong, corrosion resistant material such as stainless steel.

Bearing hub 25 is internally press fit with bearing 68, into the inner race of which the cylindrical sahft 61 of axle 60 is press fit. Axle 60 is maintained in a vertical position within hub 25 by a lower washer 69 and a locknut 70 below the hub, and an upper washer 71 and a locknut 72 above the hub. Each hull is similarly supported from its respective hub such that all hulls are in a common, horizontal plane. Each hull is in this manner free to rotate horizontally, but is constrained against vertical movement.

In the illustrated control system, the inner bearing races of three pulleys, a first pulley 80, a second pulley 81 and a third pulley 82, are press fit, one above the other with the first pulley uppermost and the third pulley bottom-most, onto the cylindrical shaft 61 of axle 60, being separated from nut 72 by a washer 83 under pulley 82. The pulleys are secured against vertical movement on axle 60 by a washer 84 and a nut lock 85 above first pulley 80. In a similar manner, first, second and third pulleys 86, 87 and 88 are mounted on axle 64 of hull 1 and pulleys 89, 90 and 91 are mounted on axle 65 of hull 2 (FIG. 1). The vertical positioning of the pulleys on their respective axles is such that first pulleys 80, 86 and 89 are in a common, upper horizontal plane, second pulleys 81, 87 and 90 are in a common, middle horizontal plane and third pulleys 82, 88 and 91 are in a common, lower horizontal plane.

For rotation of the hulls only one of the three pulleys mounted on each axle 60, 64 and 65 is nonrotatably pinned to its axle by a pin 92 (FIG. 10 for axle 60, not shown for axles 64 and 65). In this manner first pulley 86 is pinned to axle 64 of hull 1, second pulley 90 is pinned to axle 65 of hull 2, and third pulley 82 is pinned to axle 60. The remaining pulleys—pulleys 87 and 88 on hull 1 axle 64, pulleys 89 and 91 on hull 2 axle 65, and pulleys 80 and 81 on hull 3 axle 60—are not pinned to their axles and are free to rotate, thus functioning as idler pulleys. Pin 92 extends diametrically through the axle and the cable region of whichever pulley is to be nonrotatably secured to the axle and is of a length such that it does not extend completely through the pulley into the cable region. Pin 92 and the pinned pulleys are sufficiently strong that rotation of the pinned pulley (in a manner described below) transmits a rotational fore to the hull via the pin and axle.

A first continuous cable 100 interconnects first pulleys 80, 86 and 89, a second continuous cable 101 interconnects second pulleys 81, 87 and 90 and a third continuous cable 102 interconnects third pulleys 82, 88 and 91. Each cable is wrapped around each of the three pulleys its interconnects at least once so that movement of the cable rotates each pulley over which it passes. Each cable is thus routed around the triangular periphery of the spider 4, interconnecting one pinned pulley in a plane to two idler pulleys in the same plane. As a result, a longitudinal movement of third cable 102, for example, will cause pulleys 82, 88 and 91 to rotate, idler pulleys 88 and 91 rotating freely about hull 1 axle 64 and hull 2 axle 65, respectively, with third pulley 82 imparting rotational motion (in respect to spider 4) only to hull 3 through pin 92 and axle 60. In a similar manner, first cable 100 imparts rotational motion only to hull 1 through pinned first pulley 86 and second cable 101 imparts rotational motion only to hull 2 through pinned second pulley 90.

As the three cables 100, 101 and 102 extend completely around the periphery of spider 4, rotational motion of any hull 1, 2 or 3 in respect to spider 4 may be effected from any location with access to the cables.

FIGS. 9 and 10 also illustrate one method whereby equal angle rotation, in respect to spider 4, of all three hulls in unison, is achieved. A locking pin 103, of general U-shape, with a projecting handle 104 is vertically inserted through aligned holes 105 drilled in pulleys 80, 81 and 82 over hull 3. The holes in the pulleys are drilled in a circular pattern inside the cable region and are closely spaced in a symmetrical manner such that, with at most slight rotational adjustment of the pulleys, it is possible to install pin 103 vertically downward through all three pulleys. A vertical slot 106 is provided in an unthreaded upper end 107 of shift 61 to restrain the horizontal portion of pin 103 against rotation relative to the axle. In this manner additional locking of pulleys 80, 81 and 82 to axle 60, other than that by pin 92 through pulley 82, is provided.

As a result of interlocking pulleys 80, 81 and 82 at axle 60, a longitudinal pull of any cable 100, 101 or 102, at any location on the spider, will cause equal rotational motion, relative to the spider, of all three hulls.

To prevent rotation, in respect to spider 4, of any hull, hub 25 may be drilled with holes 108 in alignment with the holes 105 in pulleys 80, 81 and 82, and locking pin 103 may be vertically extended into holes 106. By this means, all three hulls may be locked to spider 4 in virtually any desirable hull configuration. This is advantageous when a particular configuration of hulls is to be maintained for a period of time.

On the other hand, when pin 103 is extended through only first and second pulleys, 80 and 81, hulls 1 and 2 may be rotated relative to spider 4 in unison by pulling either cable 100 or 101, while retaining independent control of hull 3 through cable 102. This is useful for some types of maneuvering, as described below.

Slot 106 in shaft 61 is provided with three detects 109, 110 and 111 for securing pin 103 in any of the three above-described locking positions: Detent 109 retrains pin 103 when it extends only through pulleys 80 and 81 for movement of only hulls 1 and 2 in unison, detent 110 retrains pin 103 when it extends through all three pulleys for movement of all three hulls in unison and detent 111 restrains pin 103 when it extends beyond all three pulleys into hub 25 for non-rotatably locking all three hulls to spider 4. A projection 112 on handle 104 fits into detents 109, 110 and 111 to restrain pin 103 in any of the three mentioned positions.

For convenience, locking pins substantially identical to pin 103 may be provided at a different hull or at all hulls, with the pulleys and bearing hubs at these hulls drilled to receive the locking pin in the above-described manner, and the vertical axles slotted to receive the pin. Use of locking pins at each hull will improve locking of hulls together for rotation relative to spider 4, and will improve nonrotatable locking of all hulls to spider 4, but will result in some inconvenience in operation.

The above illustrated and described method for effecting hull rotation relative to spider 4 and for locking the hulls together for rotation in unison, or to spider 4 for nonrotation, is merely illustrative of one of many possible mechanizations for manually or otherwise rotating hulls and for locking hulls together. For example, geared sprockets, in lieu of pulleys, and chain drives, in lieu of cables, may be used. Or, instead of hand pulled cables, cables may be moved by wheels, cranks, levers or motors, wherever located, and individual controls may be used at each hull without hull interlocking provisions.

In summary, one preferred embodiment of the invention, with two variations of spiders and two alternative methods of achieving substantial hydrodynamic continuity of aligned hulls, has been described. It has been emphasized throughout that the preferred embodiment, and the variations shown, are merely illustrative of the many possible ways in which improved longitudinal stability of plural-hull craft may be achieved by increasing leeward hull buoyancy relative to windward hull buoyancy, regardless of wind direction, without the necessity of turning the craft around, as is necessary for outrigger canoes, all of which ways are within the scope of the invention.

Although the above has described and illustrated a sailing craft wherein a third hull is shifted into longitudinal alignment at the stern of whichever of port and starboard hulls is leeward, the scope of the invention includes longitudinal alignment of a third hull forward of whichever of port and starboard hulls is leeward, as might be desirable or necessary with trimarans with the third hull forward of the port and starboard hulls.

And, although the preferred embodiment is exemplary of a sail boat for use on water, the scope of the invention includes other types of sailing craft, such as ice and sand boats, wherein longitudinal stability is increased by increasing leeward hull (or runner) length by shifting a third hull (or runner) into longitudinal alignment with whichever of a port and starboard hull (or runner) is leeward. Even though in such non-water craft increased leeward hull buoyancy is not a factor in increasing longitudinal stability, the increased leeward hull (or runner) length and weight achieved by shifting the third hull (or runner) into alignment with whichever of port and starboard hulls (or runners) is leeward has the substantially the same beneficial effect of increasing resistance against forward capsizing as does increasing leeward hull buoyancy in water sailing craft.

Operation

The craft, once the third hull 3 is aligned with whichever of the first and second hulls is leeward, is sailed in the same manner, known to those skilled in the art, for sailing a twin hull catamaran, outrigger canoe or proa. Therefore only the transition from longitudinal alignment of hull 3 with hull 1 (or 2) to longitudinal alignment of hull 3 with hull 2 (or 1) will be described, as will certain maneuvering steps.

Assume the craft is initially in a configuration shown in FIGS. 1 and 5(*a*) for a starboard tack, with hull 3 longitudinally aligned at the stern of hull 1, to the leeward of hull 2. It is desired to put about through the wind, as depicted in FIG. 5, to change to a port tack, with the desired end result that hull 3 will be longitudinally aligned astern of hull 2 (FIG. 5(*e*)).

The normal manner for accomplishing this maneuver requires bringing the craft, by means of sail and rudder (or by contrarotation of aligned hulls), to within approximately 30° of the wind and then casting the sails loose. While the craft is still moving forward, the bows of all hulls are rotated, relative to spider 4, approximately 60° to starboard, through the intermediate positions shown in FIGS. 5(*b*), (*c*) and (*d*), until hull 3 is aligned astern of hull 2. The sails are then pulled in in the usual mmaner, the boom being repositioned to starboard, and sailing on the new tack is commenced.

Even should the craft be caught in irons (i.e., stopped and heading into the wind with all force gone from the sails), the above maneuver may be completed. As long as the hulls can in some manner be rotated into the configuration of the other tack without using forces contributed by the sails or the inertia of the craft, the craft can be put about. It should be emphasized that this maneuver is accomplished without turning any hull end for end.

Turning or course changing while hulls are in the aligned configuration of, for example, FIG. 1, may be achieved by, in effect, "bending" the composite leeward hull into an approximation of an arc, as shown in FIG. 6 for a starboard turn. In this configuration the bows and sterns of the two aligned hulls are on the radius of the turn, with the remaining hull either free to trail or to rotate by itself or else fixed t spider 4. In this manner the craft may easily be steered through the turn without dragging the relatively large composite leeward hull through the turn. A port turn may be accomplished in a similar manner. Turns may also, however, be made in a conventional manner by use of rudder 5, without counterrotating the aligned hulls, as would be necessary, for example, in craft employing plural interconnect spiders without provision for individual hull rotation.

To counteract sideways drift aligned hulls may be counterrotated (FIG. 7) with the forward hull rotated equally or less than the trailing hull to "bend" the composite leeward hull into a configuration similar to that of a cambered airfoil, with the curve generally directed upwind. Downwind drift is countered by the sideways lift provided by this airfoil configuration. Any tendency of the craft to turn in this configuration may be countered by rudder 5 or by counterrotating hull 1 or 2 less than hull 3. There is some increased water drag with the composite leeward hull in the cambered airfoil configuration, as compared to the drag with the hulls in a straight aligned configuration. This configuration, however, has a high lift to drag ratio and sideways drift is countered with less drag than by use of keels or asymmetrical hulls, as is often done.

In any of the above configurations all three hulls may be nonrotatably locked to spider 4 by full insertion of locking pin 103, as previously described.

In a hull configuration with hull 3 unaligned with either hull 1 or 2 (for example, as seen in FIG. 5(*c*)), as might be assumed for sailing when the wind is from astern or when it is desired to beach the craft and a two hull abreast configuration is desirable, the craft may be maneuvered by use of rudder 5, by rotation of only hull 3, or by counterrotation of hull 3 in respect to parallel rotation of hulls 1 and 2.

Hull rotation relative to spider 4 for all of the above maneuvers is by longitudinally pulling the appropriate cable, as described in detail above.

Although the invention has been described and illustrated in detail, it is to be clearly understood that the same is by way of illustration and example only, and is not to be taken by way of limitation, the spirit and scope of this invention being limited only by the terms of the appended claims.

I claim:

1. A method of minimizing water drag of longitudinally aligned buoyant hulls without the use of flaps, filler elements or extra fairings, comprising the following steps:

(a) making the stern of a forward hull and the bow of an after hull of generally complementary conjugate shape, whereby there may be a close fit between said stern and bow even when there is some relative vertical and horizontal motion between the aligned hulls, thereby streamlining the flow of water in the region of adjacency of said hulls, and (b) rotating said forward and after hulls in parallel unison, such that the longitudinal axes of said hulls are maintained mutually parallel during rotation, through substantially equal angles in the horizontal and in the same direction of rotation until said hulls are brought into substantial longitudinal alignment with said bow of said after hull in close proximity astern of said forward hull, whereby said alignment in close proximity is effected without relative longitudinal motion between said hulls.

2. A method of minimizing water drag of longitudinally aligned buoyant hulls, comprising the following steps:

(a) installing a pliable hollow U-shaped one-piece fairing astern of a forward hull in such a manner that the lines of said forward hull are continued into said fairing, said fairing being of sufficient length to enclose the bow of an after hull, said length being such as to permit said bow to flex aside a wall portion of said fairing while entering the space enclosed within said fairing, said fairing being capable of extreme flexure without damage, and (b) moving said hulls into substantial longitudinal alignment with said bow of said after hull momentarily flexing aside said wall portion of said fairing to become enclosed within said fairing astern of said forward hull.

3. A method of minimizing water drag of longitudinally aligned buoyant hulls, comprising the following steps:

(a) installing in inflatable fairing astern of a forward hull in such a manner that the lines of said forward hull are continued into said fairing, said fairing being of sufficient length to enclose the bow of an after hull, and (b) longitudinally aligning said after hull with said forward hull while concurrently moving the bow of said after hull into close proximity with the stern of said forward hull, wherein longitudinal alignment in said close proximity is accomplished even in the absence of any longitudinal relative motion, wherein said fairing substantially encloses said stern of said forward hull and said bow of said after hull while allowing some relative vertical and horizontal motion between said hulls during such time that said hulls are longitudinally aligned in said close proximity, whereby said fairing achieves a streamlined flow of water around the region of adjacency of said bow and said stern.

4. A substantially hydrodynamically continuous buoyant structure comprising:

(a) at least one forward and one after hull, said hulls being fitted with strong hull attachment means, (b) propulsion means, (c) interconnecting means connected to said hull attachment means and to said propulsion means, whereby said hulls may be caused to be simultaneously rotated into substantial longitudinal alignment in close proximity wherein said interconnecting means cause the longitudinal axes of said hulls to be mutually parallel during rotation, and also whereby said hulls may be caused to be propelled in unison, and (d) means for streamlining the contours of said forward hull into said after hull, said streamlining means being capable of allowing substantial relative lateral motion between said hulls when said hulls are in close proximity.

5. The substantially hydrodynamically continuous buoyant structure of claim 4, wherein said means for streamlining includes substantially complementary conjugate structure at the stern of said forward hull and at the bow of said after hull.

6. The substantially hydrodynamically continuous buoyant structure of claim 5, wherein said bow of said after hull is streamlined.

7. The substantially hydrodynamically continuous buoyant structure of claim 5, wherein said bow of said after hull is forwardly inclined from the vertical.

8. The substantially hydrodynamically continuous buoyant structure of claim 5, wherein said bow of said after hull is downwardly convex.

9. The substantially hydrodynamically continuous buoyant structure of claim 4, wherein said means for streamlining includes a pliable one-piece continuous fairing attached to the stern of said forward hull, said fairing enclosing the bow of said after hull, of a length short enough to permit said bow to flex it aside momentarily while entering the space enclosed by said fairing.

10. The substantially hydrodynamically continuous buoyant structure of claim 9, wherein said pliable fairing is an extended open U-shaped continuous structure.

11. The substantially hydrodynamically continous buoyant structure of claim 9, wherein said pliable fairing is inflatable.

12. The substantially hydrodynamically continuous buoyant structure of claim 4, wherein said propulsion means includes at least one sail.

13. The substantially hydrodynamically continous buoyant structure of claim 4, wherein said means for streamlining includes fore and aft lines of said after hull which are continuations of the fore and aft lines of said forward hull.

14. A method of minimizing water drag of longitudinally aligned buoyant hulls, without the use of flaps, filler elements or extra fairings, comprising the following steps:

(a) making a forward hull and an after hull such that the fore and aft lines of said after hull continue the fore and aft lines of said forward hull, thereby streamlining the flow of water along said hulls, whereby said aligned hulls form a composite hull having substantial hydrodynamic continuity, and (b) rotating both said forward and after hulls in parallel unison, such that the longitudinal axes of said hulls are maintained mutually parallel during rotation, through substantially equal angles in the horizontal and in the same direction of rotation until said hulls are brought into substantial longitudinal alignment with the bow of said after hull in close proximity astern of said forward hull, whereby said alignment in close proximity is effected without relative longitudinal motion between said hulls.

15. A plural-hull craft, comprising:

(a) hull means for buoyantly supporting the craft in water, said means including a port hull, a starboard hull and a third hull, each said hull being buoyant and having at least one vertical pivotal axle, said port and starboard hulls being substantially identical in size and shape, said third hull being shaped to be a continuation of the contours of said port and starboard hulls whereby when said third hull is aligned longitudinally closely astern of either said port hull or said starboard hull the two aligned said hulls establish substantial hydrodynamic continuity and form a composite hull, (b) interconnection means for pivotally interconnecting said port, starboard and third hulls at said pivotal axles and in a generally horizontal plane, with lateral separation between said port and starboard hulls and with said third hull aft of said port and starboard hulls, (c) control means for rotating said hulls in said plane to longitudinally align said third hull closely astern of whichever of said port and starboard hulls is leeward, regardless of whether the wind is from the port or starboard side of the craft, (d) means for streamlining water flow about the region of adjacency of said aligned hulls, and (e) sail means for propelling the craft.

* * * * *

UNITED STATES PATENT OFFICE

CERTIFICATE OF CORRECTION

Patent No. 4,213,412 Dated July 22, 1980

Inventor Robert S. Jamieson

It is certified that error appears in the above-identified patent and that said Letters Patent are hereby corrected as shown below:

Column 8, line 54, change "alinged" to ---aligned---.

Column 10, line 1, change "has" to ---as---.

Column 12, line 39, change "sahft" to ---shaft---.

Column 13, line 20, change "its" to ---it---.

Column 14, line 5, change "detects" to ---detents---,
line 7, change "retrains" to ---restrains---,
line 10, change "retrains" to ---restrains---.

Column 15, line 33, change "mmanner" to ---manner---,
line 51, change "t" to ---to---.

Column 17, lines 16 through 23, remove indentation,
line 41, indent line 41.

Column 18, line 39, indent line 39,
line 41, indent line 41,
line 43, indent line 43.

Signed and Sealed this

*Twenty-eighth* Day of *October 1980*

[SEAL]

*Attest:*

SIDNEY A. DIAMOND

*Attesting Officer*

*Commissioner of Patents and Trademarks*